US008381628B1

(12) United States Patent
Wheatley

(10) Patent No.: US 8,381,628 B1
(45) Date of Patent: Feb. 26, 2013

(54) AMBIDEXTROUS FIREARM RECEIVER WITH REAR CHARGING HANDLE

(76) Inventor: Craig Wheatley, Bonners Ferry, ID (US)

( * ) Notice: Subject to any disclaimer, the term of this patent is extended or adjusted under 35 U.S.C. 154(b) by 1 day.

(21) Appl. No.: 13/214,375

(22) Filed: Aug. 22, 2011

Related U.S. Application Data

(60) Provisional application No. 61/376,953, filed on Aug. 25, 2010.

(51) Int. Cl.
*B64D 1/04* (2006.01)

(52) U.S. Cl. ..... 89/1.4; 42/43; 42/69.01

(58) Field of Classification Search ..... 89/1.4; 42/43, 69.01
See application file for complete search history.

(56) References Cited

U.S. PATENT DOCUMENTS

| | | | | |
|---|---|---|---|---|
| 3,225,653 | A | 12/1965 | Packard | |
| 4,515,064 | A * | 5/1985 | Hohrein | 89/128 |
| 7,240,600 | B1 | 7/2007 | Bordson | |
| 7,302,881 | B1 | 12/2007 | Tertin | |
| 7,735,409 | B1 * | 6/2010 | Tertin | 89/128 |
| 2008/0083319 | A1 | 4/2008 | Richeson | |
| 2011/0061523 | A1 * | 3/2011 | Webb | 89/128 |

* cited by examiner

*Primary Examiner* — J. Woodrow Eldred
(74) *Attorney, Agent, or Firm* — Wood, Herron & Evans, LLP

(57) ABSTRACT

An ambidextrous receiver and bolt operating assembly for use in combination with a standard bolt for a Ruger® 10/22® rim-fire firearm action. A receiver housing is configured to function with the original Ruger® 10/22® firearm bolt and has an ejection port which is smaller than the ejection port of the original Ruger® 10/22® receiver and which does not include a bolt handle reciprocation opening. The receiver housing also includes a longitudinally extending upper guide channel and an opening at an aft end of said channel. A bolt closure mechanism is adapted to bias the original Ruger® 10/22® firearm bolt into battery and to be received in a seat of the original firearm bolt. The engagement member does not include a laterally extending bolt operating handle. An ambidextrous charging handle is positioned in the channel and has a forward portion including a hook portion adapted to retract the original firearm bolt during rearward movement of said handle. The handle has a T-shaped aft portion extending out of said opening in said receiver housing.

4 Claims, 3 Drawing Sheets

AMBIDEXTROUS FIREARM RECEIVER WITH REAR CHARGING HANDLE

TECHNICAL FIELD

This invention relates to a receiver upon which a complete rifle or pistol may be built, or which may be a replacement or conversion receiver, for an otherwise standard Ruger 10/22® rifle or Ruger Charger™ pistol. In particular, it relates to a receiver that eliminates the need for a laterally-extending, reciprocating bolt handle and provides an ambidextrous, rear charging handle that does not reciprocate with the bolt when fired, but otherwise uses standard Ruger 10/22®/Ruger Charger™ parts.

BACKGROUND OF THE INVENTION

The Ruger 10/22® rifle, first introduced in 1964, is a very popular semi-automatic rim-fire firearm in .22LR caliber manufactured by Sturm, Ruger & Co. of Southport, Conn. Others have made variations to the basic rifle, including modified barrels, additional safety mechanisms, modified trigger mechanisms, caliber changes, and modifications to the stock. The bolt and internal dimensions of the 10/22® receiver have remained unchanged and are widely recognized as standardized. The dimensional specifications for these parts have been published and are available to the public (or for purchase) simply by searching "10/22 blueprint" images on an on-line search engine. As a result, interchangeable aftermarket parts are widely available.

As produced by Ruger, both the 10/22® rifle and Charger™ pistol use a functionally identical receiver and include a charging handle which extends laterally from the right side of the receiver. Accordingly, it is awkward at best to manually cycle the action with the user's left hand. A right handed shooter is not naturally inclined to reach across the rifle and charge the bolt on the right side of the rifle with his left hand. Instead, the user typically must put the rifle in his left hand and operate the charging handle with his right hand, which takes his shooting grip off the rifle each time.

The standard lateral charging handle mates to, and reciprocates with, the bolt (or breech block). Because the handle represents a mass that reciprocates each time the action cycles, changing its size (and, hence, its mass) as others have done for ease of manual operation may affect the proper cycling of the action. In other cases, the mass may be intentionally altered in order to achieve proper cycling when different ammunition loads or ammunition of a different caliber is used. For example, bolt handle modifications are discussed in U.S. Pat. No. 7,302,881, entitled Conversion Kit and Method for a Ruger 10/22 Semi-automatic .22 Caliber Rim Fire Rifle to Shoot .17 MACH 2 Cartridges, issued Dec. 4, 2007, and in U.S. Patent Application Publication No. 2008/0083319, entitled Charging Handle, published Apr. 10, 2008.

SUMMARY OF THE INVENTION

The present invention provides a receiver upon which a rifle or pistol may be built or which may be used as a replacement receiver and rear charging handle which can be used with other standard parts of a Ruger® 10/22® rifle or Charger™ pistol. The receiver of the present invention incorporates a charging handle in the rear of the receiver that eliminates the traditional factory charging handle on the side of the rifle. The charging handle is enclosed and operates within an upper portion of the receiver, which may incorporate integral Picatinny accessory mounting rail. The charging handle does not reciprocate with the bolt each time the rifle is fired and it is held in the closed position by a spring-loaded ball detent.

The absence of a laterally-extending charging handle allows the ejection port size to be decreased, since the port only needs to allow the ejection of spent brass and does not have to be elongated to accommodate reciprocation of a charging handle. Because the ejection port is smaller, dirt or other extraneous debris is less likely to enter the receiver or obstruct proper cycling of the bolt. The absence of a side charging handle also provides a smooth side to the firearm and prevents inadvertently catching the charging handle on clothing or brush when transporting or handling the rifle.

The central, rear position of charging handle of the present invention, with a T-shaped grip, is truly ambidextrous and offers the same convenient charging location for either right or left handed shooters. Other benefits and features of the present invention will become apparent from a review of the drawings and the detailed description of a preferred mode of carrying out the invention.

BRIEF DESCRIPTION OF THE DRAWINGS

Like reference numerals are used to indicate like parts throughout the various figures of the drawing, wherein.

PREFERRED MODE OF CARRYING OUT THE INVENTION

Figure 1:
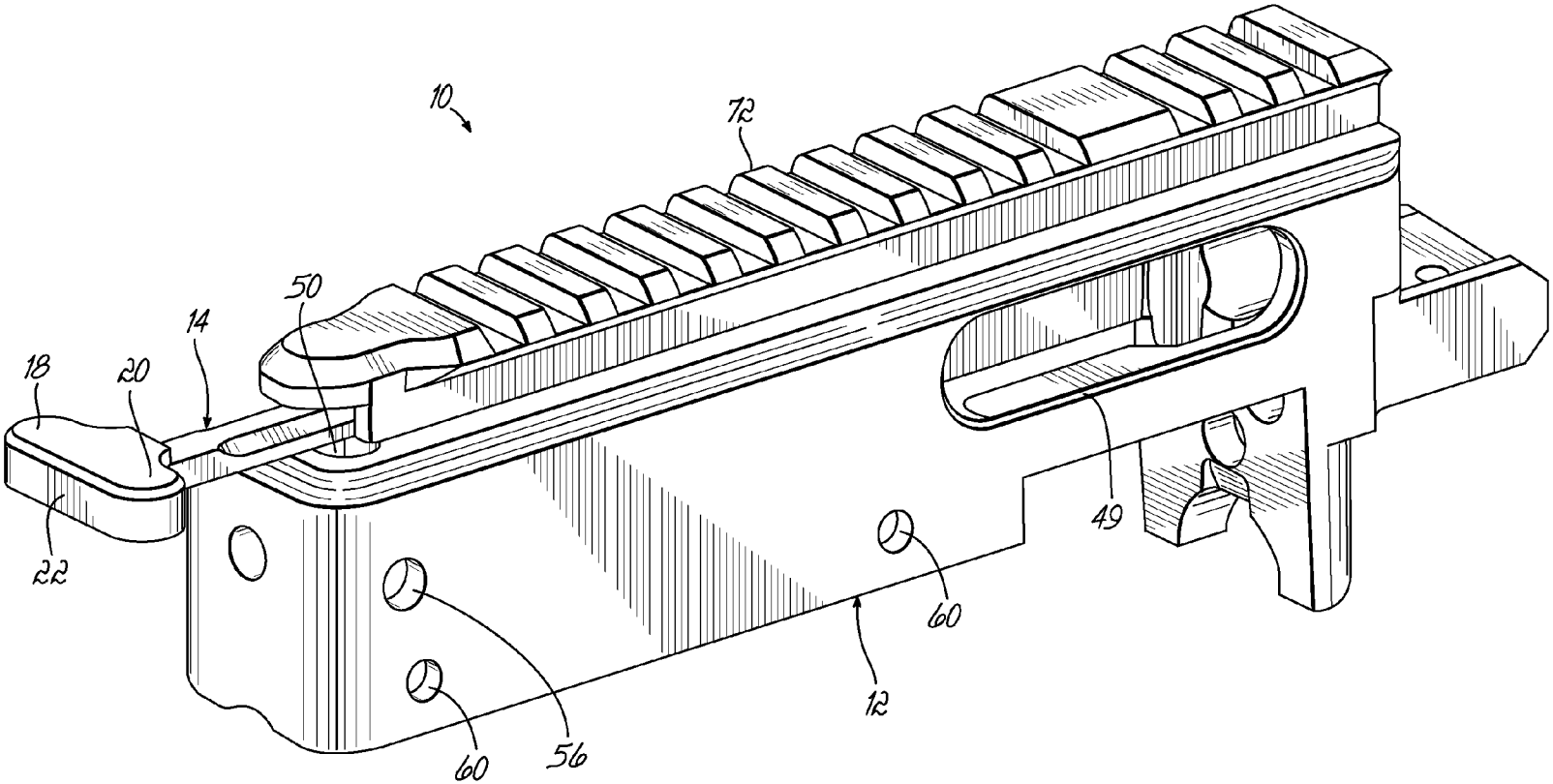
FIG. 1 is a pictorial view of a receiver and charging handle according to a preferred embodiment of the present invention.
Figure 2:
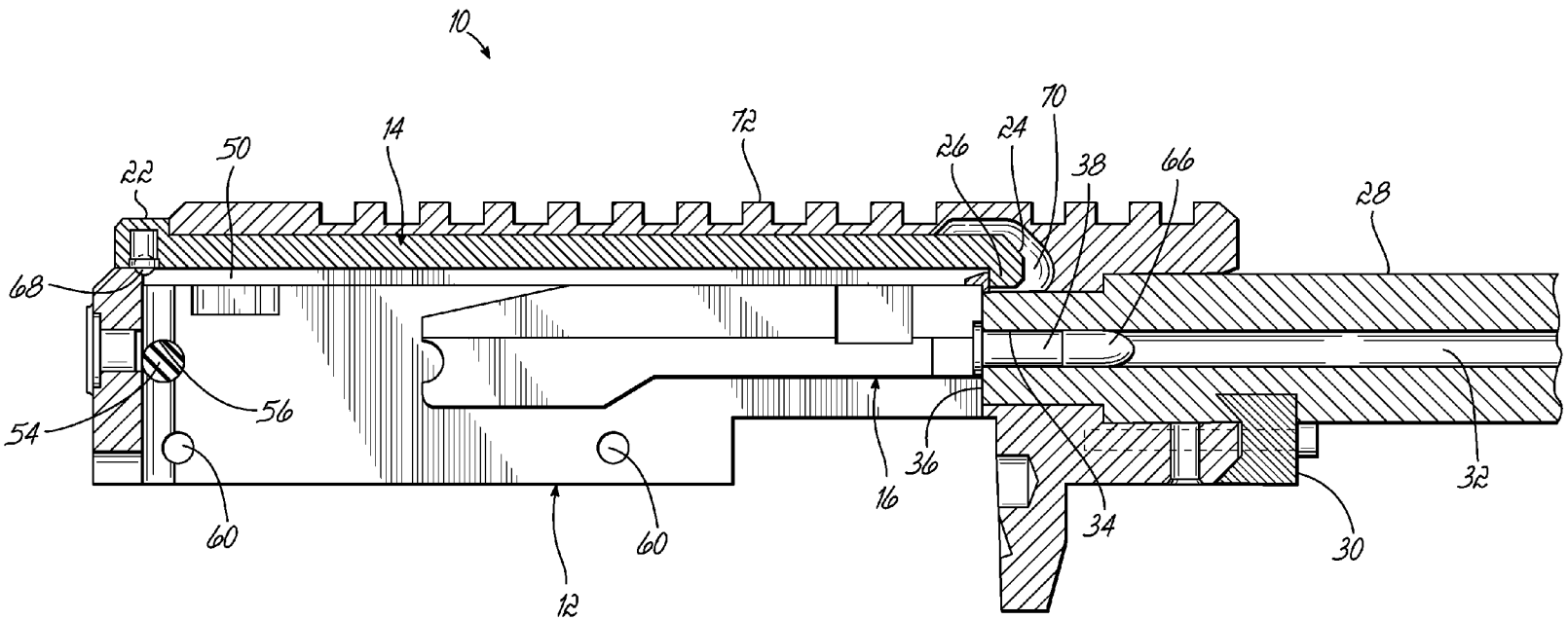
FIG. 2 is a longitudinal sectional view of the receiver, charging handle, bolt, and portion of the barrel.

Referring first to FIG. 1, therein is shown at 10 a preferred embodiment of a replacement receiver 12 adapted to accept and operate with a rearwardly-extending, fully ambidextrous charging handle 14. Referring now also to FIG. 2, it can be seen that the charging handle 14 is positioned within the receiver 12 above the standard Ruger 10/22® or Charger™ bolt assembly 16. The charging handle 14 includes lateral extensions 18, 20 at its rearward end 22 to form a T-shaped gripping portion. A forward end 24 of the charging handle 14 includes a downwardly-extending hook portion 26 which is configured to engage a forward edge of the reciprocating bolt assembly 16. As used herein, the terms Ruger 10/22® and Charger™ are used interchangeably, inasmuch as all parts are standardized interchangeable (apart from the legalities restricting conversion between rifle and pistol configurations and minimum barrel length).

The receiver 12 is configured at its forward end to accept and engage a standard Ruger 10/22® (or Charger™) barrel 28. The barrel 28 is secured to the receiver 12 by way of a retainer member or V-block 30 according to well-known practice. The barrel 28 includes a central bore 32 and a chamber 34 at its breech end 36 to accept a standard .22 Long Rifle rim fire cartridge 38.

In its battery position, the bolt 16 confronts the breech end 36 of the barrel 28, and head of the ammunition cartridge 38. The manner in which the bolt assembly 16 functions and interoperates with the barrel 28 is unchanged in any way from that provided in the standard Ruger 10/22® rifle or Charger™ pistol, other than the manner by which it is manually cycled, as described below.

Figure 3:
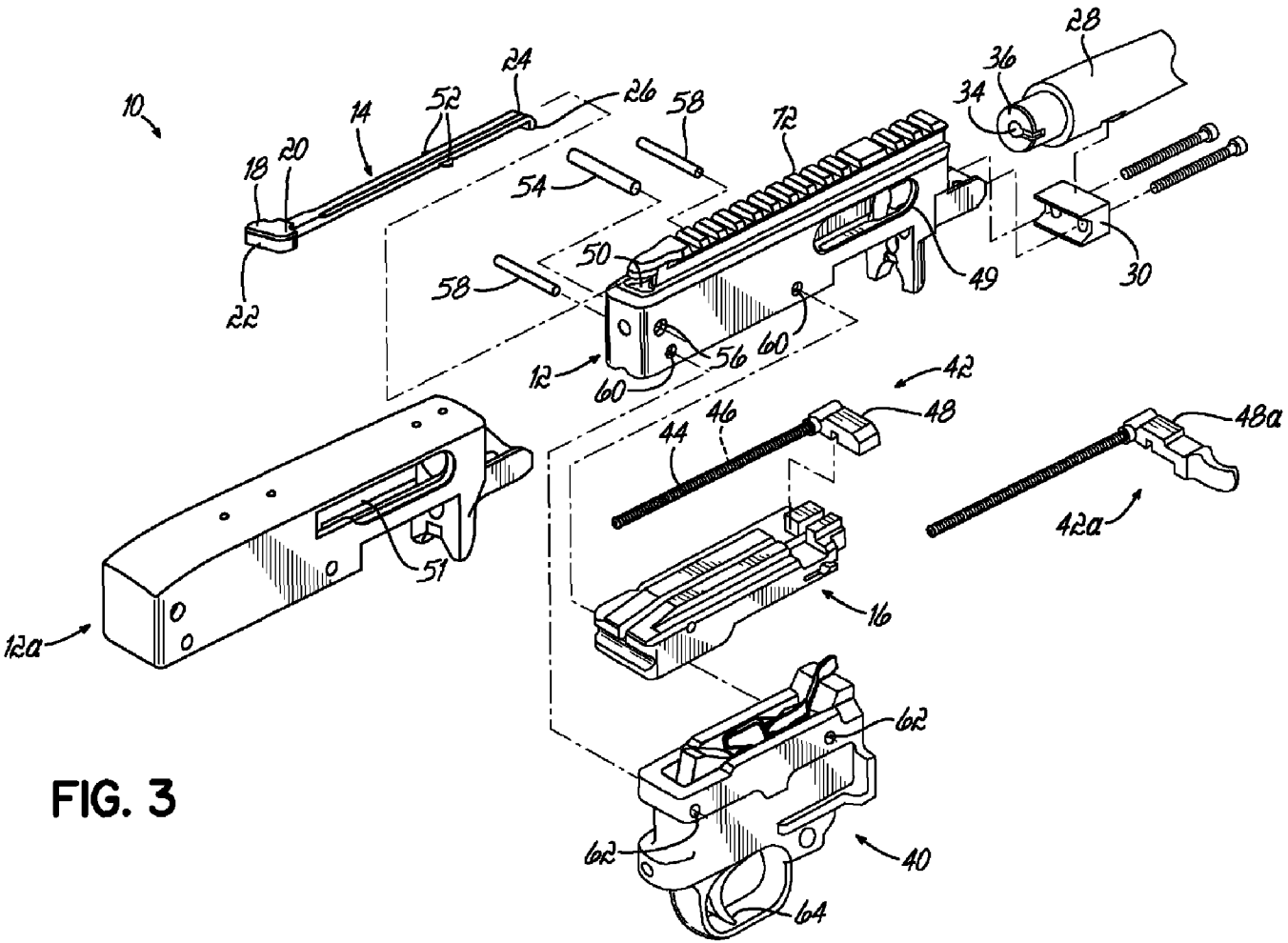
FIG. 3 is an exploded view of the structures shown in FIG. 2, plus the trigger assembly and representations of the standard receiver and recoil spring group replaced by the present invention.

Referring now also to FIG. 3, therein is seen an exploded view of the receiver 12, charging handle 14, and bolt assembly 16. Also shown are the trigger assembly 40 and a recoil spring assembly 42 which includes the recoil spring 44, guide rod 46, and engagement member 48. For reference purposes, a standard Ruger 10/22® receiver (which is identical to that of a Ruger Charger™) is shown at 12*a* and a standard bolt handle, guide rod, and recoil spring assembly are shown at 42*a* in FIG. 3. For purposes of the present invention, the standard bolt handle 48*a* is replaced with the bolt engagement member 48, as shown, a laterally-extending handle being rendered obsolete. In practice, the entire assembly 42 may be exchanged for the original assembly 42*a*. Replacement of the entire assembly 42*a* eliminates the consumer having to disassemble and reassemble the recoil spring 44 and guide rod 46, two parts which are very low cost to replace.

Also as shown in FIG. 3, the receiver 12 of the present invention maintains all dimensional characteristics of the standard receiver 12*a* that allow it to interface and operate with the remaining standard parts of the Ruger 10/22® rifle or Charger™ pistol. In addition to the accommodation of the charging handle 14, the ejection port 49 of the receiver 12 is significantly reduced in size compared to the standard receiver 12*a*. In particular, the extended opening 51 in the standard receiver 12*a* to allow reciprocation of the standard bolt handle 48*a* can be eliminated.

Referring still in particular to FIG. 3, assembly of the firearm is accomplished much like that of the standard Ruger 10/22® or Charger™. The barrel 28 is secured to the receiver 12 with the barrel retainer or V-block 30. A bolt stop pin or buffer 54 is laterally inserted through and held by opposite openings 56 in the receiver 12. Different is that the charging handle 14 is first inserted into the receiver 12 through a rear upper opening 50. Guide flanges 52 are positioned in elongated guide grooves (not shown) inside the receiver 12 to facilitate longitudinal sliding movement of the charging handle 14. The recoil spring assembly 42 and bolt assembly 16 are positioned in the receiver 12 through the bottom of the receiver 12 in the normal manner, although there is no lateral bolt handle (48*a*) to insert into the ejection port 49 (or extended opening 51). The trigger assembly 40 is secured in place to the receiver 12 by lateral insertion of cross pins 58 which extend through openings 60 in the receiver 12 and corresponding openings 62 in the trigger assembly 40.

Referring again to FIG. 2, a cartridge 38 is manually fed into the chamber 34 from a magazine (not shown) by pulling the charging handle 14 rearwardly, which retracts the bolt assembly 16 by engagement of the downward projection 26, and then releasing the charging handle 14 to allow the handle 14 and bolt assembly 16 to be propelled by the recoil spring 44 forward into the battery position. Actuation of the trigger 64 causes the firing pin (not shown) in the bolt assembly 16 to be propelled forward and strike the rim of the cartridge 38, igniting the ammunition propellant. When the cartridge 38 is fired, a bullet 66 is propelled through the bore 32 of the barrel 28. Likewise, the casing of the cartridge 38 is propelled rearwardly, causing the bolt 16 to reciprocate to the rear.

When the bolt 16 is cycled by the firing of a cartridge 38, the charging handle 14 does not reciprocate. Engagement between the bolt 16 and charging handle 14 is solely by the downward projection 26 at the forward end 24 of the charging handle 14. This provides a one-way engagement, which allows retraction of the charging handle 14 to retract the bolt 16, but otherwise allows reciprocation of the bolt 16 independently of the charging handle 14 when the action is cycled automatically by firing.

While the bolt 16 is cycling, or while the bolt 16 is locked in an out-of-battery position, the charging handle 14 is retained in the forward position by means of a spring-biased detent ball 68 positioned on the underside of the rearward end 22 of the charging handle 14. The detent ball 68 engages the opening 50 in the top of the receiver 12 to retain the charging handle 14 in place, but allows it to be manually displaced by a user with a minimal amount of force.

An enlarged cavity 70 may be provided in the interior of the receiver 12, generally surrounding the forward end 24 of the charging handle 14 when it is at its forwardmost position. By allowing sufficient space in this area, minimal amounts of combustion residue or other grime that may accumulate will not obstruct or prevent the charging handle 14 and bolt 16 from returning fully to their in-battery position. Moreover, this area can easily be cleaned without disassembly of component parts when the charging handle and bolt 16 are fully retracted. Because a guide channel is required in the top of the receiver 12 for accommodating the charging handle 14, the outer profile of the receiver 12 top may include an integral Picatinny rail 72 for mounting optics or other accessories.

In preferred form, the receiver 12 is milled from a billet of 6061 T6 aluminum and the charging handle 14 is milled from stainless steel, though the particular materials are not essential to the present invention. Because the receiver 12 is considered a "firearm" under U.S. federal law, it must be manufactured and transferred in accordance with all state and federal laws.

It is intended that the above description and accompanying drawings are to be interpreted as illustrative only and not limiting. Changes in the details and structure may be made without departing from the spirit and scope of the invention, which is defined by the following claims.

What is claimed is:

1. An ambidextrous receiver and bolt operating assembly for use in combination with a standard bolt for a semiautomatic rim-fire firearm action, the original bolt operating assembly of the firearm having a laterally extending bolt operating handle that reciprocates with the standard bolt of the firearm and which extends through a side ejection port sized to accommodate reciprocation of the bolt operating handle, the said ambidextrous receiver and bolt operating assembly comprising:

a receiver housing configured to function with a reciprocating firearm bolt, said receiver housing having an ejection port opening which does not include a bolt handle reciprocation opening extending from and beyond the ejection opening, said receiver housing further including a longitudinally extending upper guide channel and an opening in said receiver housing at an aft end of said channel;

a bolt closure mechanism adapted to bias the firearm bolt into battery, said mechanism comprising a guide rod having a stop on one end, a recoil spring positioned over said guide rod, and an engagement member slidably mounted over the other end of said guide rod such that movement of said engagement member toward said stop compresses said recoil spring, said engagement member adapted to be received in a seat of the original firearm bolt and devoid of any laterally extending bolt operating handle; and an ambidextrous charging handle positioned in said channel of said receiver housing, said handle having a forward portion including a hook portion adapted to retract the original firearm bolt during rearward movement of said handle, said handle having an aft gripping portion extending out of said opening in said receiver housing.

2. The ambidextrous receiver and bolt operating assembly of claim 1, wherein the charging handle includes a detent for holding the charging handle in a forward position until manually retracted.

3. The ambidextrous receiver and bolt operating assembly of claim 1, wherein the aft gripping portion of the charging handle is T-shaped.

4. The ambidextrous receiver and bolt operating assembly of claim 1, wherein the receiver housing includes an accessory attachment rail longitudinally positioned along the top thereof.

* * * * *